US011402786B2

(12) United States Patent
Kimura et al.

(10) Patent No.: US 11,402,786 B2
(45) Date of Patent: Aug. 2, 2022

(54) RECORDING MEDIUM CONVEYANCE DEVICE, RECORDING MEDIUM CONVEYANCE METHOD AND NON-TRANSITORY COMPUTER-READABLE RECORDING MEDIUM ENCODED WITH RECORDING MEDIUM CONVEYANCE PROGRAM

(71) Applicant: Konica Minolta, Inc., Tokyo (JP)

(72) Inventors: Taku Kimura, Toyokawa (JP); Masahiro Nonoyama, Toyokawa (JP); Junichi Masuda, Toyokawa (JP); Masahiro Kamiya, Toyohashi (JP); Katsuhide Sakai, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/313,250

(22) Filed: May 6, 2021

(65) Prior Publication Data

US 2021/0364973 A1 Nov. 25, 2021

(30) Foreign Application Priority Data

May 21, 2020 (JP) ..... JP2020-088559

(51) Int. Cl.
*G03G 15/00* (2006.01)

(52) U.S. Cl.
CPC ..... *G03G 15/6561* (2013.01); *G03G 15/50* (2013.01)

(58) Field of Classification Search
CPC ..... G03G 15/50; G03G 15/6561
See application file for complete search history.

(56) References Cited

U.S. PATENT DOCUMENTS 7,404,559 B2 * 7/2008 Yoshimura ..... B65H 7/125 271/262
2007/0138738 A1 6/2007 Motohashi et al.

FOREIGN PATENT DOCUMENTS

JP 2007168928 A 7/2007

* cited by examiner

*Primary Examiner* — Walter L Lindsay, Jr.
*Assistant Examiner* — Andrew V Do
(74) *Attorney, Agent, or Firm* — Buchanan Ingersoll & Rooney PC

(57) ABSTRACT

A recording medium conveyance device includes storage that stores a recording medium, a conveyer that takes out the recording medium stored in the storage and conveys the recording medium as a conveyed object, an ultrasonic sensor that outputs a value indicating an attenuation amount of an ultrasonic wave caused by the conveyed object and a hardware processor, wherein the hardware processor executes an overlay detection process of detecting whether the conveyed object is in an overlay state in which a gap is present based on a result of output by the ultrasonic sensor, and prevents execution of the overlay detection process with respect to a first conveyed object that is to be conveyed first by the conveyer.

21 Claims, 9 Drawing Sheets

RECORDING MEDIUM CONVEYANCE DEVICE, RECORDING MEDIUM CONVEYANCE METHOD AND NON-TRANSITORY COMPUTER-READABLE RECORDING MEDIUM ENCODED WITH RECORDING MEDIUM CONVEYANCE PROGRAM

The entire disclosure of Japanese patent Application No. 2020-088559 filed on May 21, 2020 is incorporated herein by reference in its entirety.

BACKGROUND

Technological Field

The present invention relates to a recording medium conveyance device, a recording medium conveyance method and a non-transitory computer-readable recording medium encoded with a recording medium conveyance program. In particular, the present invention relates to a recording medium conveyance device that detects double feeding of a recording medium, a recording medium conveyance method executed in the recording medium conveyance device and a non-transitory computer-readable recording medium encoded with a recording medium conveyance program that causes a computer to execute the recording medium conveyance method.

Description of the Related Art

In an image forming apparatus such as an MFP (Multi Function Peripheral), papers are taken out one by one from a cassette storing a plurality of papers to be conveyed, and an image is formed on a paper being conveyed. When a paper is taken out from the cassette, a plurality of papers may be overlaid on one another. An ultrasonic sensor has been known as a sensor for detecting overlaying of a plurality of papers. The ultrasonic sensor detects an attenuation rate of an ultrasonic wave that has transmitted through a measured object. In the case where there is a gap between a plurality of papers, the attenuation rate is significantly reduced as compared to the case of one sheet of paper.

Meanwhile, a recording medium on which an image is to be formed by the MFP is not limited to one sheet of paper, and there is an overlay paper such as an envelope in which two papers are overlaid on each other. Japanese Patent Laid-Open No. 2007-168928 describes a sheet carrying unit that includes a double feed detecting means for detecting double feed of sheets and a stopping means for stopping carrying of a sheet based on a detection result of the double feed detecting means, and includes an accepting means for accepting a type of a sheet to be carried, wherein the stopping means is characterized in being configured to stop carrying a sheet based on the type of sheet accepted by the accepting means and a detection result of the double feed detecting means.

However, with the sheet carrying unit described in Japanese Patent Laid-Open No. 2007-168928, a type of a sheet to be carried is required to be input to the sheet carrying unit. Therefore, a user is required to set a type of a sheet in advance, and a user operation is complicated. Further, in the case where the type of a sheet to be carried is not set, an envelope is misjudged as being double fed. Therefore, there is a problem of misjudgment.

SUMMARY

According to one aspect of the present invention, a recording medium conveyance device includes a storage that stores a recording medium, a conveyer that takes out the recording medium stored in the storage and conveys the recording medium as a conveyed object, an ultrasonic sensor that outputs a value indicating an attenuation amount of an ultrasonic wave caused by the conveyed object, and a hardware processor, wherein the hardware processor executes an overlay detection process of detecting whether the conveyed object is in an overlay state in which a gap is present based on a result of output by the ultrasonic sensor, and prevents execution of the overlay detection process with respect to a first conveyed object that is to be conveyed first by the conveyer.

According to another aspect of the present invention, a recording medium conveyance device includes a storage that stores a recording medium, a conveyer that takes out the recording medium stored in the storage and conveys the recording medium as a conveyed object, an ultrasonic sensor that outputs a value indicating an attenuation amount of an ultrasonic wave caused by the conveyed object, and a hardware processor that, in the case where the conveyer sequentially conveys a plurality of the conveyed objects, judges a conveyance state of a second conveyed object that is to be conveyed second or later based on a result of output by the ultrasonic sensor in regard to each of a first conveyed object that is to be conveyed first by the conveyer and the second conveyed object.

According to yet another aspect of the present invention, a recording medium conveyance method is executed in an image forming apparatus, wherein the image forming apparatus includes a storage that stores a recording medium, a conveyer that takes out the recording medium stored in the storage and conveys the recording medium as a conveyed object, and an ultrasonic sensor that outputs a value indicating an attenuation amount of an ultrasonic wave caused by the conveyed object, and the recording medium conveyance method causes the image forming apparatus to execute an overlay detection step of executing an overlay detection process of detecting whether the conveyed object is in an overlay state in which a gap is present based on a result of output by the ultrasonic sensor, and a prevention step of preventing execution of the overlay detection process with respect to a first conveyed object that is to be conveyed first by the conveyer.

According to yet another aspect of the present invention, a recording medium conveyance method is executed in an image forming apparatus, wherein the image forming apparatus includes a storage that stores a recording medium, a conveyer that takes out the recording medium stored in the storage and conveys the recording medium as a conveyed object, and an ultrasonic sensor that outputs a value indicating an attenuation amount of an ultrasonic wave caused by the conveyed object, and the recording medium conveyance method includes a conveyance state step of, in the case where the conveyer sequentially conveys a plurality of the conveyed objects, judging a conveyance state of a second conveyed object that is to be conveyed second or later among the plurality of the conveyed objects by the conveyer based on a result of output by the ultrasonic sensor in regard to a first conveyed object that is to be conveyed first by the conveyer among the plurality of the conveyed objects.

According to yet another aspect of the present invention, a non-transitory computer-readable recording medium is encoded with a recording medium conveyance program that is executed in a computer that controls an image forming apparatus, wherein the image forming apparatus includes a storage that stores a recording medium, a conveyer that takes out the recording medium stored in the storage and conveys the recording medium as a conveyed object, an ultrasonic sensor that outputs a value indicating an attenuation amount of an ultrasonic wave caused by the conveyed object, and the recording medium conveyance program causes the computer to execute an overlay detection step of executing an overlay detection process of detecting whether the conveyed object is in an overlay state in which a gap is present based on a result of output by the ultrasonic sensor, and a prevention step of preventing execution of the overlay detection process with respect to a first conveyed object that is to be conveyed first by the conveyer.

According to yet another aspect of the present invention, a non-transitory computer-readable recording medium is encoded with a recording medium conveyance program that is executed in a computer that controls an image forming apparatus, wherein the image forming apparatus includes a storage that stores a recording medium, a conveyer that takes out the recording medium stored in the storage and conveys the recording medium as a conveyed object, an ultrasonic sensor that outputs a value indicating an attenuation amount of an ultrasonic wave caused by the conveyed object, and the recording medium conveyance program causes the computer to execute a conveyance state step of, in the case where the conveyer sequentially conveys a plurality of the conveyed objects, judging a conveyance state of a second conveyed object that is to be conveyed second or later by the conveyer among the plurality of the conveyed objects based on a result of output by the ultrasonic sensor in regard to a first conveyed object that is to be conveyed first by the conveyer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
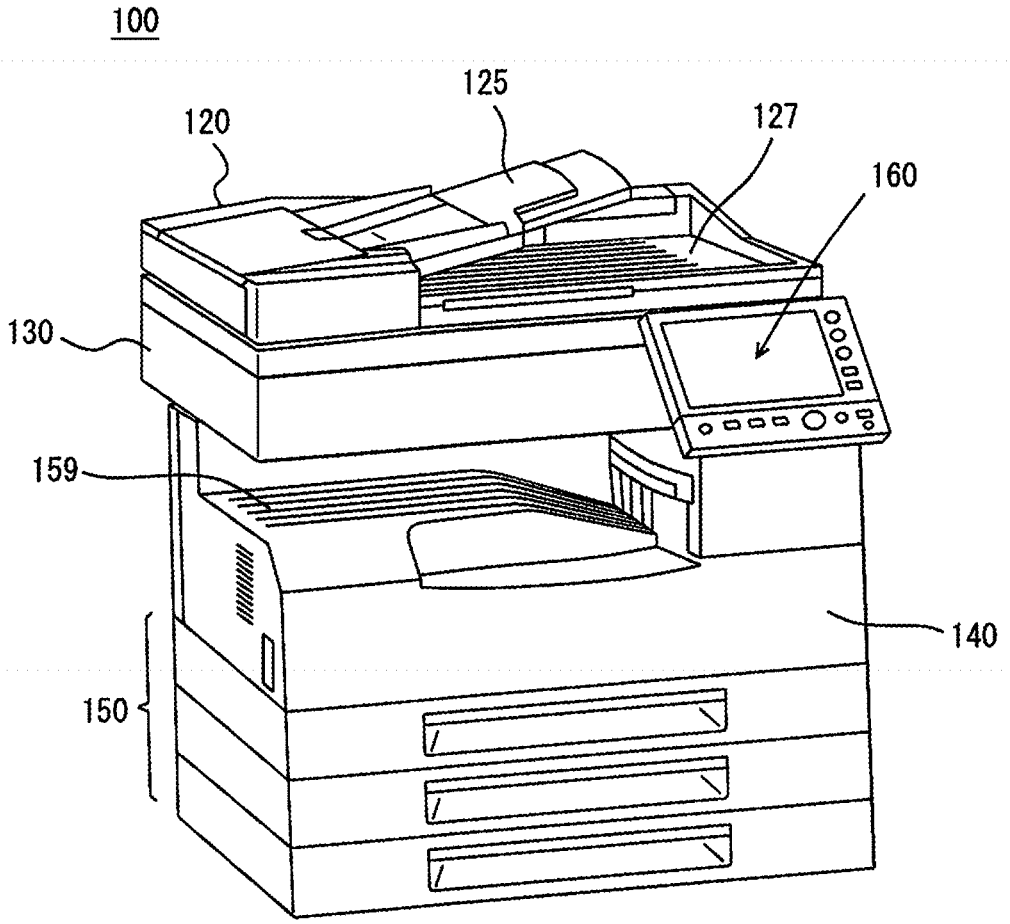
FIG. 1 is a perspective view showing the appearance of an MFP in the present embodiment.

Hereinafter, one or more embodiments of the present invention will be described with reference to the drawings. However, the scope of the invention is not limited to the disclosed embodiments.

An image forming apparatus in embodiments of the present invention will be described below with reference to the drawings. In the following description, the same parts are denoted with the same reference characters. Their names and functions are also the same. Thus, a detailed description thereof will not be repeated. Further, in the following description, an MFP is explained as one example of the image forming apparatus. Further, in the MFP described below, a paper (a sheet of paper) such as a plain paper, a wood free paper, a recycled paper or a photo paper, or an overlay paper having two sheets of paper being overlaid on each other similarly to an envelope, is used as a recording medium on which an image is to be formed.

Figure 2:
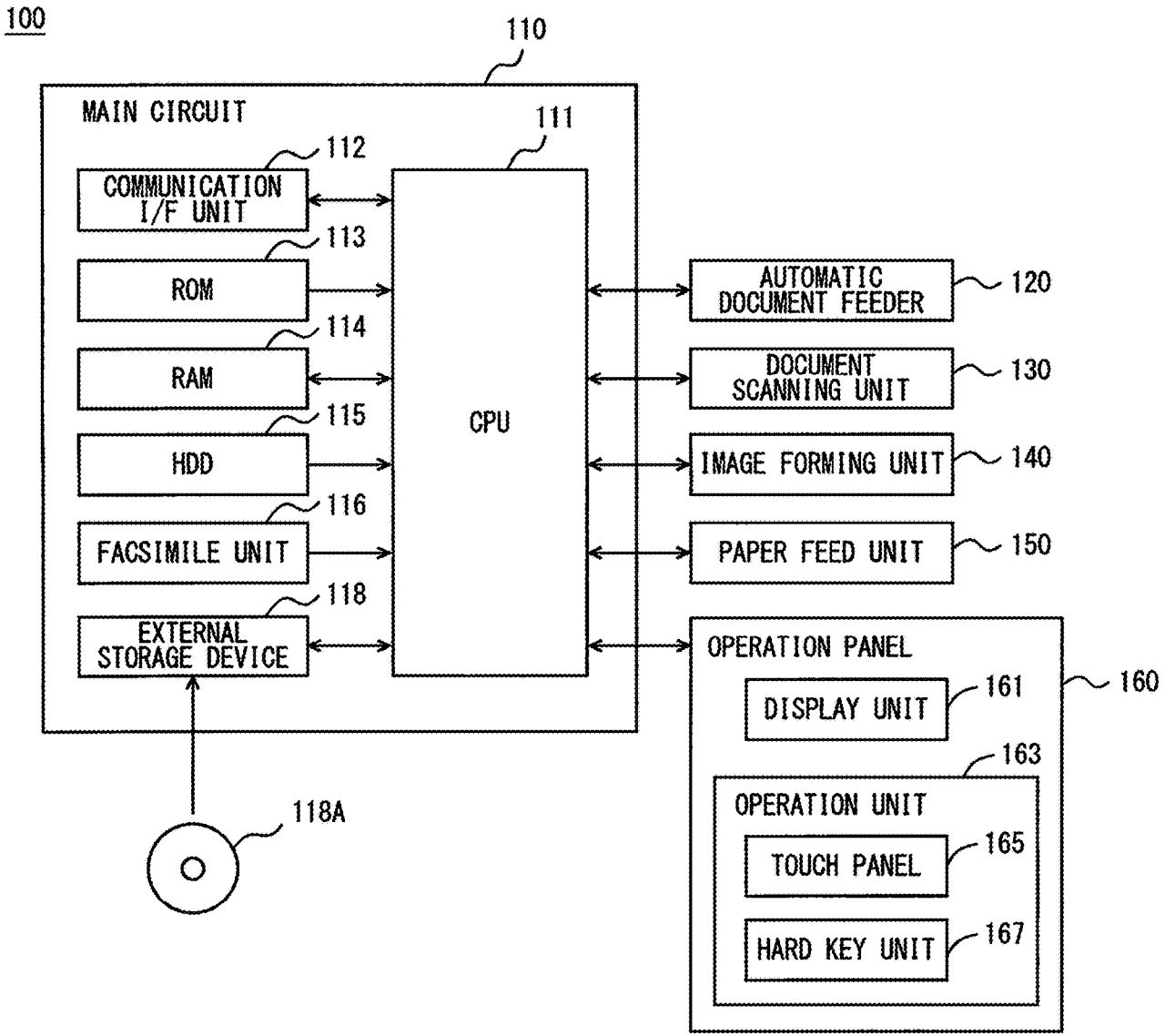
FIG. 2 is a block diagram showing the overview of a hardware configuration of the MFP.

FIG. 1 is a perspective view showing the appearance of the MFP in the present embodiment. FIG. 2 is a block diagram showing the overview of the hardware configuration of the MFP. With reference to FIGS. 1 and 2, the MFP 100 is one example of the image forming apparatus, and includes a main circuit 110, a document scanning unit 130 for scanning a document, an automatic document feeder 120 for conveying a document to the document scanning unit 130, an image forming unit 140 for forming an image on a recording medium based on image data, a paper feed unit 150 for supplying a recording medium to the image forming unit 140 and an operation panel 160 serving as a user interface.

The automatic document feeder 120 automatically conveys a plurality of documents set on a document tray 125 to a document scanning position of the document scanning unit 130 one by one, and discharges a document having an image formed thereon and scanned by the document scanning unit 130 onto a document discharge tray 127. The automatic document feeder 120 includes a document detection sensor for detecting a document placed on the document tray 125.

The document scanning unit 130 has a rectangular scanning surface for scanning a document. The scanning surface is formed of a platen glass, for example. The automatic document feeder 120 is connected to the main body of the MFP 100 to be rotatable about an axis parallel to one side of the scanning surface, and is openable and closable. The document scanning unit 130 is arranged below the automatic document feeder 120, and the scanning surface of the document scanning unit 130 is exposed with the automatic document feeder 120 rotated and open. Thus, a user can place a document on the scanning surface of the document scanning unit 130. The automatic document feeder 120 can change between an open state in which the scanning surface of the document scanning unit 130 is exposed and a close state in which the scanning surface is covered. The automatic document feeder 120 includes a state detection sensor for detecting the open state of the automatic document feeder 120.

The document scanning unit 130 includes a light source that emits light and an optoelectronic transducer that receives light, and scans an image formed on a document placed on the scanning surface. In the case where a document is placed on a scan region, the light emitted from the light source is reflected from the document, and the reflected light forms an image on the optoelectronic transducer. When receiving the light reflected from the document, the optoelectronic transducer produces image data by converting the received light into an electrical signal. The document scanning unit 130 outputs the image data to a CPU 111 included in the main circuit 110.

The paper feed unit 150 takes out a recording medium stored in any of first to third paper feed trays and a manual paper feed tray, described below, and conveys the recording medium to the image forming unit 140 as a conveyed object.

The image forming unit 140 is controlled by the CPU 111 and forms an image on the conveyed object that is conveyed by the paper feed unit 150 using a well-known electrophotographic method. In the present embodiment, the image forming unit 140 forms an image of image data input from the CPU 111 on the conveyed object conveyed by the paper feed unit 150. The conveyed object on which the image is formed is discharged to the paper discharge tray 159. The image data that is output by the CPU 111 to the image forming unit 140 includes image data such as externally received print data in addition to image data input from the document scanning unit 130.

The main circuit 110 includes a CPU (Central Processing Unit) 111 for controlling the MFP 100 as a whole, a communication interface (I/F) unit 112, a ROM (Read Only Memory) 113, a RAM (Random Access Memory) 114, a Hard Disc Drive (HDD) 115 that is used as a mass storage device, a facsimile unit 116 and an external storage device 118. The CPU 111 is connected to the automatic document feeder 120, the document scanning unit 130, the image forming unit 140, the paper feed unit 150 and the operation panel 160, and controls the MFP 100 as a whole.

The ROM 113 stores a program executed by the CPU 111 or data required to execute the program. The RAM 114 is used as a work area for execution of a program by the CPU 111. Further, the RAM 114 temporarily stores image data successively transmitted from the document scanning unit 130.

The operation panel 160 is provided in an upper part of the MFP 100. The operation panel 160 includes a display unit 161 and an operation unit 163. The display unit 161 is a Liquid Crystal Display (LCD), for example, and displays an instruction menu for the user, information about acquired image data, etc. As long as displaying images, an organic EL (Electroluminescence) display, for example, can be used instead of an LCD.

The operation unit 163 includes a touch panel 165 and a hard key unit 167. The touch panel 165 is a capacitance type. The touch panel 165 is not limited to the capacitance type, and another type such as a resistive film type, a surface acoustic wave type, an infrared type and an electromagnetic induction type can be used.

The touch panel 165 is provided with its detection surface being overlaid on an upper surface or a lower surface of the display unit 161. Here, the size of the detection surface of the touch panel 165 and the size of the display surface of the display unit 161 are the same. Therefore, the coordinate system of the display surface and the coordinate system of the detection surface are the same. The touch panel 165 detects the position designated by the user on the display surface of the display unit 161 using the detection surface, and outputs a set of coordinates of the detected position to the CPU 111. Because the coordinate system of the display surface and the coordinate system of the detection surface are the same, the set of coordinates output by the touch panel 165 can be replaced with the set of coordinates of the display surface.

The hard key unit 167 includes a plurality of hard keys. The hard keys are contact switches, for example. The touch panel 165 detects a position designated by the user on the display surface of the display unit 161. In the case where operating the MFP 100, the user is likely to be in an upright attitude. Therefore, the display surface of the display unit 161, an operation surface of the touch panel 165 and the hard key unit 167 are arranged to face upward. This is for the purpose of enabling the user to easily view the display surface of the display unit 161 and easily provide an instruction on the operation unit 163 with his or her finger.

The communication I/F unit 112 is an interface for connecting the MFP 100 to a network. The communication I/F unit 112 communicates with another computer or a data processing apparatus connected to the network with a communication protocol such as TCP (Transmission Control Protocol) or FTP (File Transfer Protocol). The network to which the communication I/F unit 112 is connected is a Local Area Network (LAN), either wired or wireless. Further, the network is not limited to a LAN and may be a Wide Area Network (WAN), a Public Switched Telephone Network (PSTN), the Internet or the like.

The facsimile unit 116 is connected to the Public Switched Telephone Networks (PSTN) and transmits facsimile data to or receives facsimile data from the PSTN. The facsimile unit 116 stores the received facsimile data in the HDD 115, converts the facsimile data into print data that is printable in the image forming unit 140, and outputs the data to the image forming unit 140. Thus, the image forming unit 140 forms an image represented by the facsimile data received from the facsimile unit 116 on a paper. Further, the facsimile unit 116 converts the data stored in the HDD 115 into facsimile data, and transmits the facsimile data to a facsimile machine connected to the PSTN.

The external storage device 118 is controlled by the CPU 111 and mounted with a CD-ROM (Compact Disk Read Only Memory) 118A or a semiconductor memory. While the CPU 111 executes a program stored in the ROM 113 by way of example in the present embodiment, the CPU 111 may control the external storage device 118, read a program to be executed by the CPU 111 from the CD-ROM 118A and store the read program in the RAM 114 for execution.

It is noted that a recording medium for storing the program executed by the CPU 111 is not limited to the CD-ROM 118A. It may be a flexible disc, a cassette tape, an optical disc (MO (Magnetic Optical Disc)/MD (Mini Disc)/DVD (Digital Versatile Disc)), an IC card, an optical card, and a semiconductor memory such as a mask ROM and an EPROM (Erasable Programmable ROM). Further, the CPU 111 may download a program from a computer connected to the network and store the program in the HDD 115, or the computer connected to the network may write the program in the HDD 115. Then, the program stored in the HDD 115 may be loaded into the RAM 114 to be executed by the CPU 111. The program referred to here includes not only a program directly executable by the CPU 111 but also a source program, a compressed program, an encrypted program and the like.

Figure 3:
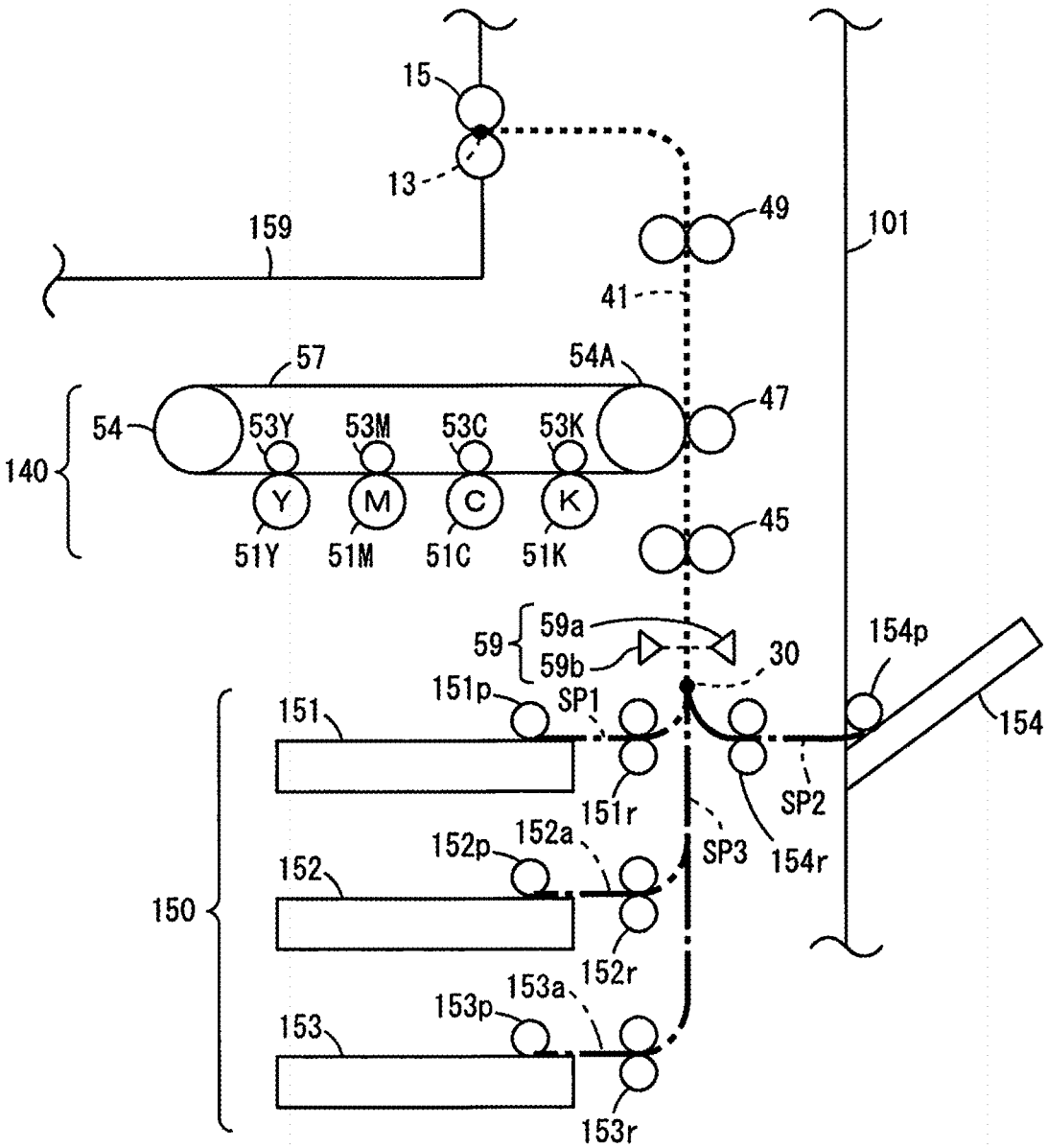
FIG. 3 is a schematic side view showing the inner configuration of part of an image forming unit and a paper feed unit.

FIG. 3 is a schematic side view showing the inner configuration of part of the image forming unit and the paper feed unit. With reference to FIG. 3, a main conveyance path 41 indicated by the thick dotted line is formed to basically extend in an up-and-down direction in the MFP 100. The main conveyance path 41 is the path for guiding a paper that is conveyed from the paper feed unit 150 to the paper discharge tray 159 through the image forming unit 140. In the main conveyance path 41 of the present example, a lower end 30 opposite to an upper end 13 located at a position farther upward than the image forming unit 140 constitutes an inlet port for receiving papers from the paper feed unit 150. Further, the upper end 13 of the main conveyance path 41 constitutes a discharge port for discharging papers on which images have been formed to the paper discharge tray 159. A paper discharge roller 15 is provided at the upper end 13 of the main conveyance path 41. The lower end 30 of the main conveyance path 41 is connected to a plurality of sub-conveyance paths SP1, SP2, SP3 of the paper feed unit 150, described below.

The paper feed unit 150 includes the three paper feed trays 151, 152, 153 and the manual paper feed tray 154. The three paper feed trays 151, 152, 153 are arranged in a stack in this order from above toward below. The manual paper feed tray 154 is provided at a sidewall 101 of the MFP 100 and located at a position farther downward than the image forming unit 140. As indicated by a thick one-dot and dash line in FIG. 3, a sub-conveyance path SP1 is formed to extend from the paper feed tray 151, which is the top tray among the three paper feed trays 151, 152, 153, to the lower end 30 of the main conveyance path 41. Further, a sub-conveyance path SP2 is formed to extend from the manual paper feed tray 154 to the lower end 30 of the main conveyance path 41. Further, two sub-conveyance paths 152*a*, 153*a* that respectively extend from the paper feed trays 152, 153, which are the middle and bottom trays among the three paper feed trays 151, 152, 153, to the lower end 30 of the main conveyance path 41 are formed. The portion having a predetermined length from the lower end 30 of the main conveyance path 41 to the point where the main conveyance path 41 branches into the two sub-conveyance paths 152*a*, 153*a* is a sub-conveyance path SP3, which is shared by the two sub-conveyance paths 152*a*, 153*a*.

A pickup roller 151*p* and a paper feed roller 151*r* are provided to correspond to the paper feed tray 151. The paper feed roller 151*r* is provided on the sub-conveyance path SP1. A pickup roller 152*p* and a paper feed roller 152*r* are provided to correspond to the paper feed tray 152. The paper feed roller 152*r* is provided on the sub-conveyance path 152*a*. A pickup roller 153*p* and a paper feed roller 153*r* are provided to correspond to the paper feed tray 153. The paper feed roller 153*r* is provided on the sub-conveyance path 153*a*. A pickup roller 154*p* and a paper feed roller 154*r* are provided to correspond to the manual paper feed tray 154. The paper feed roller 154*r* is provided on the sub-conveyance path SP2. Taking out a recording medium from each of the paper feed trays 151, 152, 153 and the manual paper feed tray 154 and conveying the recording medium are common behavior among the paper feed trays 151, 152, 153 and the manual paper feed tray 154. A recording medium is taken from the paper feed tray 151, by way of example.

In the paper feed tray 151, a stack of one or more recording media is stored. The paper feed tray 151 has a lift-up mechanism that lifts the one or more stored recording media. The pickup roller 151*p* is biased by an elastic member such as a spring to abut against the recording medium at the top among the one or more recording media stored in the paper feed tray 151 from above. The pickup roller 151*p* presses the recording medium from above. The pickup roller 151*p* rotates, so that the recording medium at the top is sent out to the sub-conveyance path SP1 by a friction force between the pickup roller 151*p* and the recording medium. The recording medium sent out to the sub-conveyance path SP1 is supplied to the main conveyance path 41 by the paper feed roller 151*r* as a conveyed object. Hereinafter, a recording medium that is sent out to the sub-conveyance path SP1 by the pickup roller 151*p* and conveyed by the paper feed roller 151*r* is referred to as a conveyed object.

With the rotation of the pickup roller 151*p*, the recording medium at the top among the one or more recording media stored in the paper feed tray 151 is sent out to the sub-conveyance path SP1 due to friction between the pickup roller 151*p* and the recording medium. A recording medium that is the second from the top and overlaps with the recording medium at the top receives a friction force from the recording medium at the top, and receives a friction force from a recording medium that is the third from the top and overlaps with the recording medium that is the second from the top. Therefore, a force that biases the pickup roller 151*p* is adjusted such that only the recording medium at the top is sent out to the sub-conveyance path SP1. However, the recording medium that is second or subsequent to the second from the top may be sent out to the sub-conveyance path SP1 together with the recording medium at the top by the pickup roller 151*p* due to a change in environment in the MFP 100. In this case, two or more recording media in an overlay state in which two or more recording media are overlaid on one another are conveyed through the sub-conveyance path SP1 by the paper feed roller 151*r*. In this manner, the paper feed unit 150 may convey a conveyed object constituted by one recording medium or may convey a conveyed object that is constituted by two or more recording media overlaid on one another. Hereinafter, conveyance of a conveyed object constituted by one recording media is referred to as single feed, and conveyance of a conveyed object constituted by two or more recording media overlaid on one another is referred to as double feed.

In the MFP 100, during image formation, a tray storing a recording medium on which an image is to be formed is selected from among the three paper feed trays 151, 52, 153 and the manual paper feed tray 154 as a subject tray. A pickup roller and a paper feed roller corresponding to a tray selected as a subject tray from among the three paper feed trays 151, 152, 153 and the manual paper feed tray 154 behave, whereby a conveyed object is supplied to the main conveyance path 41 through any of the sub-conveyance paths SP1, SP2, SP3 from a tray selected as a subject tray.

The image forming unit 140 includes respective image forming units 51Y, 51M, 51C, 51K for respective yellow, magenta, cyan and black. At least one of the image forming units 51Y, 51M, 51C, 51K is driven, so that an image is formed on a conveyed object. When all of the image forming units 51Y, 51M, 51C, 51K are driven, a full color image is formed. Printing data pieces for yellow, magenta, cyan and black are respectively input to the image forming units 51Y, 51M, 51C, 51K. The only difference among the image forming units 51Y, 51M, 51C, 51K is the color of thriller used by the image forming units 51Y, 51M, 51C, 51K. Here, the image forming unit 20Y for forming an image in yellow will be described.

The image forming unit 51Y includes an exposure head to which printing data for yellow is input, a photoreceptor drum (an image carrier), an electric charger, a developer and a transfer roller 53Y. The exposure head emits laser light in accordance with the received printing data (an electrical signal). A polygon mirror included in the exposure head scans the emitted laser light one-dimensionally to expose the photoreceptor drum. The direction in which the laser light one-dimensionally scans the photoreceptor drum is a main scan direction. After being electrically charged by the electric charger, the photoreceptor drum is irradiated with the laser light emitted by the exposure head. Thus, an electrostatic latent image is formed on the photoreceptor drum. Subsequently, toner is applied onto the electrostatic latent image by the developer, and a toner image is formed. The toner image formed on the photoreceptor drum is transferred onto an intermediate transfer belt 57 by the transfer roller 53Y.

On the other hand, the intermediate transfer belt 57 is suspended by a driving roller 54 and a roller 55A not to loosen. When the driving roller 54 rotates in an anti-clockwise direction in the diagram, the intermediate transfer belt 57 rotates in the anti-clockwise direction at a predetermined speed. The roller 54A rotates in the anti-clockwise direction due to the rotation of the intermediate transfer belt 57.

Thus, the image forming units 51Y, 51M, 51C, 51K sequentially transfer toner images onto the intermediate transfer belt 57. Timing for transferring toner images onto the intermediate transfer belt 57 by the respective image forming units 51Y, 51M, 51C, 51K is adjusted by detection of a reference mark provided on the intermediate transfer belt 57. Thus, toner images in yellow, magenta, cyan and black are superimposed on the intermediate transfer belt 57.

In the above-mentioned main conveyance path 41, a timing roller 45, a transfer roller 47 and a fuser roller 49 are arranged in this order at intervals from the lower end 30 to the upper end 13. A conveyed object that has been conveyed from the paper feed unit 150 to the main conveyance path 41 is sent to the timing roller 45.

The timing roller 45 adjusts the conveyance state of the conveyance object in the main conveyance path 41 such that the conveyed object arrives at the transfer roller 47 at a point in time at which a toner image formed on the intermediate transfer belt 57 arrives at the transfer roller 47. The conveyed object conveyed by the timing roller 45 is pressed against the intermediate transfer belt 57 by the transfer roller 47, and the transfer roller 47 is electrically charged. Thus, toner images in yellow, magenta, cyan and black that are formed on the intermediate transfer belt 57 in a superimposed manner are transferred to the conveyed object. The voltage applied to the transfer roller 47 is controlled by the CPU 111 such that an electric charge amount of the transfer roller 47 is a value suitable for the basis weight of the conveyed object.

The conveyed object to which the toner image has been transferred is conveyed to the fuser roller 49 and heated by the fuser roller 49. Thus, the toner is fused and fixed to the conveyed object. Thereafter, the conveyed object on which the image has been formed is discharged onto the paper discharge tray 159 from the upper end 13 of the main conveyance path 41 by the paper discharge roller 15. The temperature of the fuser roller 49 is controlled by the CPU 111 to be the value suitable for the basis weight of the conveyed object.

In the MFP 100 in the present embodiment, an ultrasonic sensor 59 having a detection region in the main conveyance path 41 is provided. The ultrasonic sensor 59 includes an ultrasonic wave transmitter 59*a* and an ultrasonic wave receiver 59*b* and is transmissive. The ultrasonic sensor 59 is arranged such that the ultrasonic wave transmitter 59*a* and the ultrasonic wave receiver 59*b* are arranged between the lower end 30 of the main conveyance path 41 and the timing roller 45 to be opposite to each other with the main conveyance path 41 provided therebetween. The ultrasonic wave transmitter 59*a* includes a piezoelectric element, a drive circuit of the piezoelectric element and transmits an ultrasonic wave. The ultrasonic wave receiver 59*b* includes the piezoelectric element and a detection circuit for detecting an electromotive force generated in the piezoelectric element, and detects the electromotive force generated in the piezoelectric element by the ultrasonic wave transmitted from the ultrasonic wave transmitter 59*a*. The region in the main conveyance path 41 between the ultrasonic wave transmitter 50*a* and the ultrasonic wave receiver 59*b* is the detection region.

The ultrasonic sensor 59 causes the ultrasonic wave transmitter 59*a* to transmit an ultrasonic wave with a predetermined volume to the detection region from the ultrasonic wave transmitter 59*a*. A conveyed object travels to cross the detection region with the ultrasonic wave transmitter 59*a* transmitting an ultrasonic wave to the detection region, whereby the ultrasonic wave hits a portion of the travelling conveyed object. At this time, part of the ultrasonic wave that has hit the conveyed object is transmitted through the conveyed object, and the rest of the ultrasonic wave is absorbed by the conveyed object or reflected from the conveyed object. The ultrasonic wave receiver 59*b* receives the ultrasonic wave that has been transmitted through the conveyed object, and outputs a signal corresponding to the volume of the received ultrasonic wave to the CPU 111. Here, the ultrasonic sensor 59 outputs a value indicating an attenuation amount of the ultrasonic wave. Here, the value indicating an attenuation amount of an ultrasonic wave is referred to as an attenuation rate. An attenuation rate indicates the rate of a volume of an ultrasonic wave that is transmitted through a conveyed object with respect to the volume of the transmitted ultrasonic wave. Further, a value indicating an attenuation amount of an ultrasonic wave may be a value obtained by subtraction of a receipt volume from a transmission volume.

An attenuation rate of an ultrasonic wave differs depending on a basis amount of a paper, and there is a predetermined relationship between the attenuation rate of the ultrasonic wave and the basis weight of the paper. The larger a basis weight of a paper is, the smaller an attenuation rate of an ultrasonic wave is. Therefore, the relationship between a basis weight of a paper and an attenuation rate of an ultrasonic wave is obtained by an experiment or the like in advance. Thus, a basis amount of a paper is determined from an attenuation rate of an ultrasonic wave.

In regard to an attenuation rage of an ultrasonic wave, there is a significant difference between a paper and an overlay paper. This is because two papers are overlaid on each other in an overlay paper. When two papers are overlaid on each other, a gap is present between the two papers. Therefore, the attenuation rate of an ultrasonic wave in regard to an overlay paper is significantly small as compared to an attenuation rate of an ultrasonic wave in regard to one paper. An attenuation rate of two papers that are overlaid on each other and has the smallest basis weight is smaller than an attenuation rate of a paper having the largest basis weight. Therefore, presence or absence of a gap can be detected based on an attenuation rate of an ultrasonic wave.

Further, presence or absence of a conveyed object may be detected based on an attenuation rate of an ultrasonic wave. Therefore, a position of a conveyed object may be detected based on an output value of the ultrasonic sensor 59. In this manner, the ultrasonic sensor 59 can function as a position detection sensor that detects a position of a conveyed object.

Figure 4:
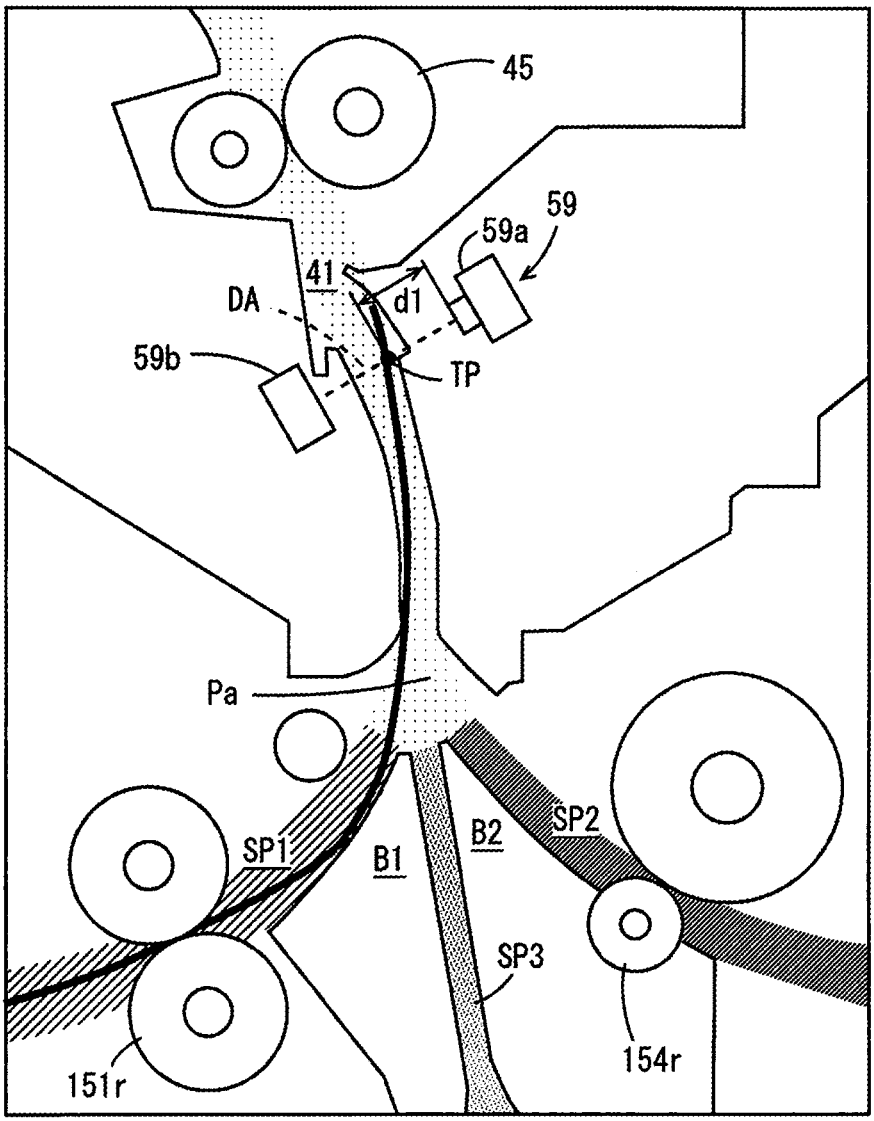
FIG. 4 is a side view showing a detection region in a conveyance path.

FIG. 4 is a side view showing the detection region in the conveyance path. In FIG. 4, two types of different hatching patterns are applied to the sub-conveyance paths SP1, SP2, and two types of different dotted patterns are applied to the main conveyance path 41 and the sub-conveyance path SP3 in order to facilitate understanding of the shapes of the main conveyance path 41 and the plurality of sub-conveyance paths SP1, SP2, SP3 and their positional relationship. Further, part of a conveyed object pa that travels through the main conveyance path 41 is shown. Here, single feed conveyance of the conveyed object pa is shown, by way of example.

As indicated by the dotted line in FIG. 4, the ultrasonic sensor 59 is arranged to have a detection region DA in the main conveyance path 41. The detection region DA of the ultrasonic sensor 59 extends in the direction that intersects with the direction in which the conveyed object pa travels and intersects with the conveyed object pa that travels through the main conveyance path 41. In the detection region DA, a target position TP is set at a position that is spaced apart from the ultrasonic wave transmitter 59*a* by a predetermined distance dl and is on a line that connects the ultrasonic wave transmitter 59*a* and the ultrasonic wave receiver 59*b*. The target position TP is an ideal position through which the conveyed object pa that travels through the main conveyance path 41 is to pass in the detection region DA for detection of a basis weight.

A distance L1 from the paper feed tray 151 to the detection region DA, a distance L2 from the paper feed tray 152 to the detection region DA, a distance L3 from the paper feed tray 153 to the detection region DA and a distance L4 from the manual paper feed tray 154 to the detection region DA are predetermined values. Further, with use of a conveyance speed at which a conveyed object is conveyed, a period of time required for the conveyed object conveyed from any of the paper feed trays 151, 152, 153 and the manual paper feed tray 154 to arrive at the detection region DA is obtained. Therefore, the timing for detecting an attenuation rate by the ultrasonic sensor 59 is obtained on the basis of a point in time at which conveyance of a conveyed object is started from any of the paper feed trays 151, 152, 153 and the manual paper feed tray 154.

Figure 5:
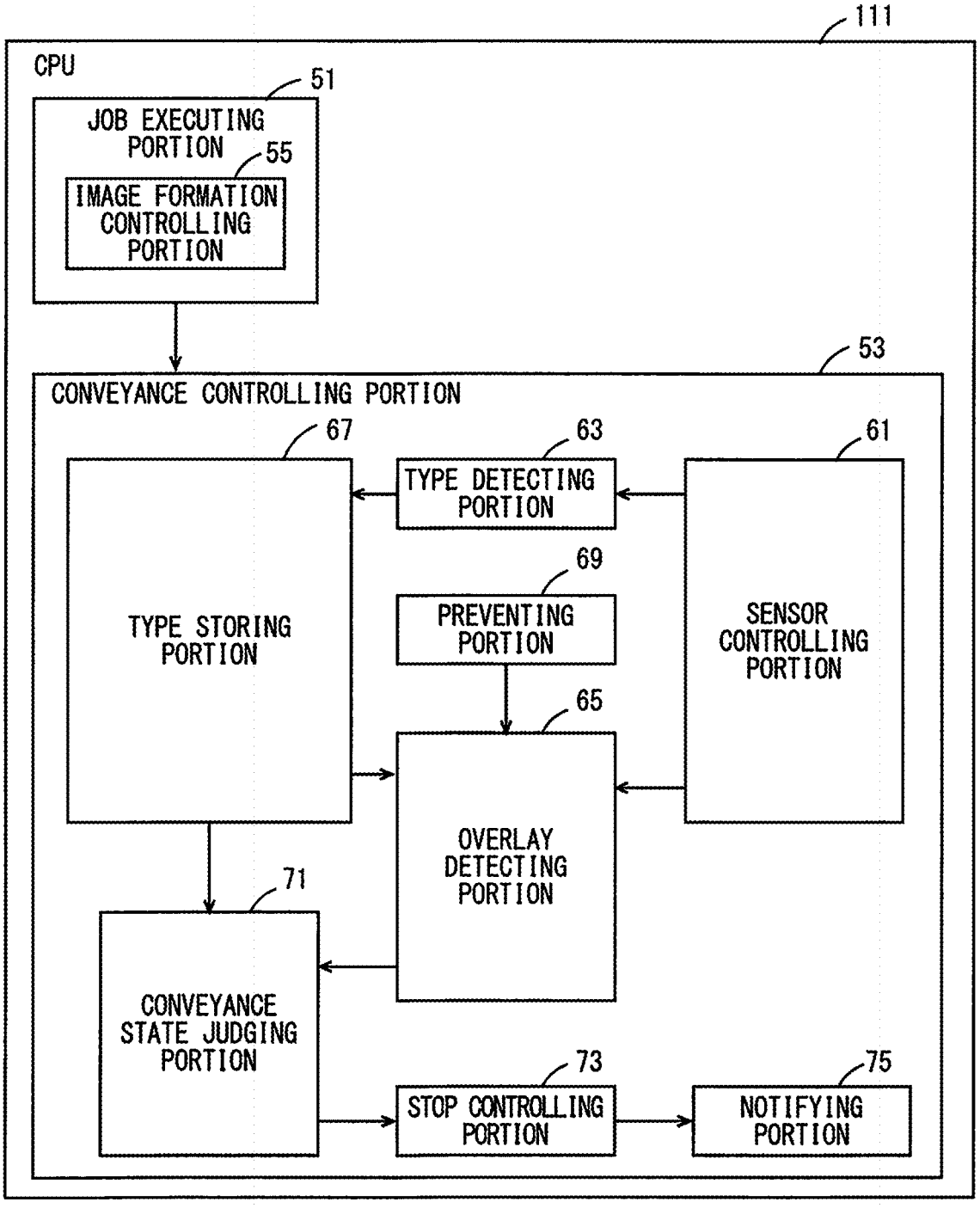
FIG. 5 is a diagram showing one example of functions of a CPU of an MFP in the present embodiment.

FIG. 5 is a diagram showing one example of the functions of the CPU of the MFP in the present embodiment. The functions shown in FIG. 5 are implemented by the CPU 111 in the case where the CPU 111 included in the MFP 100 executes a recording medium conveyance program stored in the ROM 113, the HDD 115 or the CD-ROM 118A. With reference to FIG. 5, the CPU 111 includes a job executing portion 51 and a conveyance controlling portion 53.

The job executing portion 51 executes a print job and generates printing data used to form an image by the image forming unit 140. In the case where executing a print job, the job executing portion 51 generates printing data based on data subject to image formation in accordance with a print condition. In the case where the communication I/F unit 112 receives a print job from an external computer, for example, the job executing portion 51 executes a print job. A print job is written in PJL (Printer Job Language) or PCL (Printer Control Language), for example, and includes a print condition and data subject to image formation. Further, in the case where the user operates the operation unit 163, the job executing portion 51 executes a job designated by the user. The job designated by the user includes a print condition and data subject to image formation. The data subject to image formation is the data designated by the user. The data designated by the user includes image data output by the document scanning unit 130 that has scanned a document, data stored in the HDD 115 and data stored in an external computer.

Printing data is bitmap data, for example. The printing data corresponds to the size of a paper on which an image is to be formed and defines an image to be formed on a paper by a plurality of pixel values. The printing data includes four data pieces respectively corresponding to yellow, magenta, cyan and black. Therefore, in the case where having a plurality of pages, the printing data includes four data pieces respectively corresponding to yellow, magenta, cyan and black for each of the plurality of pages.

The conveyance controlling portion 53 controls the paper feed unit 150 and conveys a paper stored in any of the three paper feed trays 151, 152, 153 and the manual paper feed tray 154 as a conveyed object. The conveyance controlling portion 53 selects a tray defined by default or a tray designated by the user as a subject tray from among the three paper feed trays 151, 152, 153 and the manual paper feed tray 154. The conveyance controlling portion 53 controls a pickup roller and a paper feed roller for supplying a paper to the image forming unit 140 from a subject tray among the three paper feed trays 151, 152, 153 and the manual paper feed tray 154. For example, the conveyance controlling portion 53 rotates the pickup roller 151*p* and the paper feed roller 151*r* in the case where the paper feed tray 151 is selected as a subject tray. Further, the conveyance controlling portion 53 rotates the pickup roller 152*p* and the paper feed roller 152*r* in the case where the paper feed tray 152 is selected as a subject tray. Further, the conveyance controlling portion 53 rotates the pickup roller 153*p* and the paper feed roller 153*r* in the case where the paper feed tray 153 is selected as a subject tray. Further, the conveyance controlling portion 53 rotates the pickup roller 153*p* and the paper feed roller 153*r* in the case where the manual paper feed tray 154 is selected as a subject tray. With this control, a conveyed object is conveyed from any of the paper feed trays 151, 152, 153 and the manual paper feed tray 154 to the main conveyance path 41.

The conveyance controlling portion 53 includes a sensor controlling portion 61, a type detecting portion 63, an overlay detecting portion 65, a type storing portion 67, a preventing portion 69, a conveyance state judging portion 71, a stop controlling portion 73 and a notifying portion 75. The sensor controlling portion 61 controls the ultrasonic sensor 59, acquires an attenuation rate of an ultrasonic wave and outputs the attenuation rate of the ultrasonic wave to the type detecting portion 63 and the overlay detecting portion 65. The sensor controlling portion 61 acquires an attenuation rate output by the ultrasonic sensor 59 when a conveyed object supplied from the paper feed unit 150 to the main conveyance path 41 by the conveyance controlling portion 53 travels through the detection region of the ultrasonic sensor 59.

The type detecting portion 63 executes a type detection process in response to input of an attenuation rate of an ultrasonic wave from the sensor controlling portion 61. The type detection process is a process of determining a type of a recording medium, which is a conveyed object, based on an attenuation rate of an ultrasonic wave and outputting the determined type of the recording medium to the type storing portion 67. The type of a recording medium includes a paper and an overlay paper. Further, a paper is a plain paper, a wood free paper, a recycled paper or a photo paper. An overlay paper is an envelope, for example. A value that is larger than the maximum value of an attenuation rate of an ultrasonic wave obtained by an experiment in regard to an overlay paper and smaller than the minimum value of an attenuation rate of an ultrasonic wave obtained by an experiment in regard to a paper is prepared as a threshold value. The type detecting portion 63 detects a type of a conveyed object by comparing an attenuation rate of an ultrasonic wave input from the sensor controlling portion 61 with the threshold value. Specifically, if an attenuation rate of an ultrasonic wave input from the sensor controlling portion 61 is equal to or smaller than the threshold value, the type detecting portion 63 judges that a recording medium is an overlay paper. If an attenuation rate of an ultrasonic wave input from the sensor controlling portion 61 is larger than the threshold value, the type detecting portion 63 judges that a recording medium is a paper.

Further, the type detecting portion 64 detects a basis weight of a recording medium, which is a conveyed object, based on an attenuation rate of an ultrasonic wave. The relationship between an attenuation rate of an ultrasonic wave and a basis weight is obtained in advance by an experiment or simulation, and the obtained relationship is maintained Therefore, the type detecting portion 64 determines a basis weight from an attenuation rate of an ultrasonic wave based on the relationship. Further, the type detecting portion 64 determines a type of a recording medium from a determined basis weight by making reference to a table defining the relationship between a type of a recording medium and a basis weight. The type detecting portion 63 outputs a type of a recording medium to the type storing portion 67. In the present embodiment, the type detecting portion 64 determines which one of a plain paper, a wood free paper, a recycled paper and a photo paper a type of a conveyed object is based on an attenuation rate of an ultrasonic wave.

The job executing portion 51 includes an image formation controlling portion 55. The image formation controlling portion 55 controls the image forming unit 140 and causes the image forming unit 140 to form an image of printing data in accordance with a print condition. The image formation controlling portion 55 controls the image forming unit 140 such that the transfer roller 47 is electrified to an electric potential that is suitable for transferring a toner image formed on the intermediate transfer belt 57 to a conveyed object on which an image is to be formed based on printing data and a basis weight. Further, the image formation controlling portion 55 determines an image forming condition based on a basis weight and forms an image in accordance with the image forming condition. For example, in the case where a basis weight of a conveyed object is large, an electrification amount of the transfer roller 47 is set higher, and a temperature of the fuser roller 49 is set higher. On the other hand, in the case where a basis weight of a conveyed object is small, an electrification amount of the transfer roller 47 is set lower, and a temperature of the fuser roller 49 is set lower. Further, an image forming condition may include a conveyance speed of a conveyed object required to transfer and fuse a toner image on a paper. For example, in the case where a basis weight of a conveyed object detected by the ultrasonic sensor 59 is large, a conveyance speed of the conveyed object is set lower. In the case where a basis weight of a conveyed object detected by the ultrasonic sensor 59 is small, a conveyance speed of the conveyed object is set higher. A conveyance speed of a conveyed object can be adjusted by control of rotation speeds of a pickup roller, a paper feed roller, the timing roller 45, the transfer roller 47, the fuser roller 49 and the paper discharge roller 15 of the paper feed unit 150.

The type storing portion 67 stores a type of a recording medium input from the type detecting portion 63 in the RAM 114 in association with a subject tray.

The overlay detecting portion 65 receives an attenuation rate of an ultrasonic wave from the sensor controlling portion 61 and receives a type of a recording medium stored in a subject tray from the type storing portion 67. In the case where a prevention signal has not been received from the preventing portion 69, described below, the overlay detecting portion 65 executes an overlay detection process in response to input of an attenuation rate of an ultrasonic wave from the sensor controlling portion 61. In other words, in the case where a prevention signal is input from the preventing portion 69, the overlay detecting portion 65 does not execute the overlay detection process. In the case where a prevention signal is not input from the preventing portion 69, the overlay detecting portion 65 executes the overlay detection process. The overlay detection process is a process of judging whether a conveyed object is in the overlay state in which a gap is present based on an attenuation rate of an ultrasonic wave with reference to a type of a recording medium. In the case where a conveyed object is in the overlay state, the conveyed object has a gap formed between a plurality of recording media. Therefore, the overlay detecting portion 65 determines whether a conveyed object is in the overlay state by comparing an attenuation rate of an ultrasonic wave that is input from the sensor controlling portion 61 with the threshold value. Specifically, a value that is smaller than a minimum value of an attenuation rate of an ultrasonic wave obtained by an experiment is prepared as a threshold value in regard to a type of a recording medium. If an attenuation rate of an ultrasonic wave input from the sensor controlling portion 61 is equal to or smaller than the threshold value defined with respect to the type of the recording medium of a conveyed object, the overlay detecting portion 65 judges that the conveyed object is in the overlay state. If the attenuation rate of the ultrasonic wave input from the sensor controlling portion 61 is larger than the threshold value, the overlay detecting portion 65 judges that the conveyed object is not in the overlay state. The overlay detecting portion 65 outputs a result of detection to the conveyance state judging portion 71.

The preventing portion 69 prevents execution of the overlay detection process by the overlay detecting portion 65 with respect to a first conveyed object that is to be conveyed first from a subject tray. In the case where preventing execution of the overlay detection process by the overlay detecting portion 65, the preventing portion 69 outputs a prevention signal to the overlay detecting portion 65. The first conveyed object is a conveyed object that is to be conveyed first from a subject tray by the paper feed unit 150.

Specifically, in the case where a subject tray is any of the paper feed trays 151, 152, 153, a first conveyed object is a conveyed object that is to be conveyed first after the subject tray changes from the open state to the close state. The preventing portion 69 detects a change in state of any of the paper feed trays 151, 152, 153 from the open state to the close state. In the close state, a pickup roller can take out a recording medium from each of the paper feed trays 151, 152, 153. When the user pulls out each of the paper feed trays 151, 152, 153, each of the paper feed trays 151, 152, 153 changes from the close state to the open state in which papers can be supplied. In the case where each of the paper feed trays 151, 152, 153 changes from the open state to the close state after changing from the close state to the open state, a stored recording medium may be changed to a different type of a recording medium. Therefore, the preventing portion 69 prevents execution of the overlay detection process with respect to a conveyed object that is to be conveyed first from a subject tray after a recording medium stored in the subject tray among the paper feed trays 151, 152, 153 is changed to another type of a recording medium.

In the case where a subject tray is the manual paper feed tray 154, the first conveyed object is a conveyed object that is to be conveyed first from the manual paper feed tray 154 after the manual paper feed tray 154 changes from a state in which a paper is not detected to a state in which a paper is detected. The manual paper feed tray 154 is provided with a sensor that detects absence or presence of a recording medium. Based on output from the sensor, the preventing portion 69 detects a change from a state in which a recording medium stored in the manual paper feed tray 154 is not detected to a state in which a recording medium stored in the manual paper feed tray 154 is detected. A recording medium is not detected by the sensor with the recording medium not stored in the manual paper feed tray 154. In the case where the user supplies a recording medium to the manual paper feed tray 154, the recording medium is detected by the sensor. After the manual paper feed tray 154 changes from a state in which a recording medium is not stored to a state in which a recording medium is stored, the stored recording medium may be changed to another type of a recording medium. Thus, the preventing portion 69 prevents execution of the overlay detection process with respect to a conveyed object that is to be conveyed first after the manual paper feed tray 154 changes from a state in which a recording medium is not stored to a state in which a recording medium is stored.

The first conveyed object is a conveyed object that is to be conveyed first from a subject tray after the MFP 100 recovers from a power saving mode. The MFP 100 switches a behavior mode to either one of a normal mode and the power saving mode in which power consumption is lower than the power consumption in the normal mode. In case of the power saving mode, a sensor for detecting opening and closing of the paper feed trays 151, 152, 153 and a sensor for detecting a recording medium provided in the manual paper feed tray 154 do not behave in order to suppress power consumption. Therefore, in the power saving mode, a recording medium stored in any one of the paper feed trays 151, 152, 153 and the paper feed tray 154 may be replaced with another type of a recording medium. The preventing portion 69 prevents execution of the overlay detection process with respect to a conveyed object that is to be conveyed first from a subject tray among the paper feed trays 151, 152, 153 and the manual paper feed tray 154 after the MFP 100 recovers from the power saving mode.

Further, the first conveyed object is a conveyed object that is to be conveyed first from a subject tray among the paper feed trays 151, 152, 153 and the manual paper feed tray 154 after the MFP 100 restarts after stopping an image formation behavior due to an error such as paper jam caused by a conveyed object being stuck. During stop of behavior of the MFP 100, a recording medium stored in any of the paper feed trays 151, 152, 153 and the manual paper feed tray 154 may be switched to another type of a recording medium. Therefore, the preventing portion 69 prevents execution of a double feed detection process with respect to a conveyed object that is to be conveyed first from a subject tray from among the paper feed trays 151, 152, 153 and the manual paper feed tray 154 when the MFP 100 restarts after stopping an image forming behavior during execution of a job.

Further, the first conveyed object is a conveyed object that is to be conveyed first from a subject tray in the case where a job to form images of a plurality of pages is executed by the job executing portion 51. The preventing portion 69 judges whether a job to form images of a plurality of pages is executed with reference to a print condition that is set in regard to a job to be executed by the job executing portion 51. In the case where execution of a job is started, the preventing portion 69 prevents execution of the double feed detection process with respect to a conveyed subject that is to be conveyed first from a subject tray among the paper feed trays 151, 152, 153 and the manual paper feed tray 154.

In the case where the job executing portion 51 executes a job to form images of a plurality of pages, the preventing portion 69 prevents the overlay detecting portion 65 from executing the overlay detection process with respect to a conveyed object that is to be conveyed first from a subject tray. However, in the case where a job to be executed by the job executing portion 51 is a predetermined type of a specific job, the preventing portion 69 does not prevent execution of the overlay detection process with respect to the conveyed object that is to be conveyed first from the subject tray. Therefore, because the preventing portion 69 does not output a prevention signal to the overlay detecting portion 65, the overlay state is detected by the overlay detecting portion 65. A specific job is a job with a predetermined set condition. A predetermined condition is a condition that defines a type of a recording medium on which an image is to be formed. For example, a specific job is a print job that is generated by an application program for printing addresses on envelopes. Further, a specific job is a print job in which the manual paper feed tray 154 is designated.

Further, in the case where the job executing portion 51 executes a job to form images of a plurality of pages, the preventing portion 69 prevents execution of the overlay detection process with respect to a conveyed object that is to be conveyed first from a subject tray. However, in the case where a job to be executed by the job executing portion 51 gives an instruction for switching the subject tray, the preventing portion 69 does not prevent execution of the overlay detection process with respect to a conveyed object that is to be conveyed first from a new selected subject tray after the subject tray is switched. Specifically, in the case where a job to be executed by the job executing portion 51 provides an instruction for switching a tray, the preventing portion 69 causes the overlay detecting portion 65 to execute the overlay detection process without outputting a prevention signal. This is due to the following reason. In the case where a job to be executed by the job executing portion 51 has provided an instruction for switching a subject tray, the subject tray is switched automatically. However, the type of a recording medium stored in either of the subject trays before and after the switch is the same. In the case where a type of a recording medium is not associated with the subject tray after the switch, a type of a recording medium associated with the subject tray before the switch is associated with the subject tray after the switch.

Further, in the case where the job executing portion 51 executes a job to form images of a plurality of pages, the preventing portion 69 prevents execution of the overlay detection process with respect to a conveyed object that is to be conveyed first from a subject tray. However, in the case where the cumulative rotation count of a pickup roller corresponding to a subject tray is equal to or larger than a predetermined rotation count, the preventing portion 69 does not prevent execution of the overlay detection process with respect to a conveyed object that is to be conveyed first from the subject tray. Specifically, in the case where the cumulative rotation count of a pickup roller corresponding to a subject tray is equal to or larger than the predetermined rotation count, the preventing portion 69 does not output a prevention signal to the overlay detecting portion 65 in regard to a conveyed object to be conveyed first from the subject tray and causes the overlay detecting portion 65 to execute the overlay detection process. The cumulative rotation count of a pickup roller is the number of rotations that has been cumulatively counted since manufacture of the MFP 100 or replacement due to maintenance. This is because a pickup roller wears by use, a friction force between the pickup roller and a recording medium is reduced, and probability of taking out a plurality of recording media at a time is high.

In the case where the job executing portion 51 executes a job to form images of a plurality of pages, and a conveyed object is taken out first from a subject tray, if execution of the overlay detection process is prevented by the preventing portion 69, a pressing force of a pickup roller is set to a first pressing force, and a conveyance speed of the conveyed object is set to a first conveyance speed. In the case where the job executing portion 51 executes a job to form images of a plurality of pages, and a conveyed object is taken out first from a subject tray, if execution of the overlay detection process is not prevented by the preventing portion 69, a pressing force of a pickup roller is set to a second pressing force, and a conveyance speed of the conveyed object is set to a second conveyance speed. Further, in the case where a recording medium is taken out second or later from the subject tray, the conveyance controlling portion 53 sets a pressing force of a pickup roller to the second pressing force, and sets a conveyance speed of a conveyed object to the second conveyance speed. The first pressing force is larger than the second pressing force. Further, the first conveyance speed is lower than the second conveyance speed. Thus, the friction force between the first conveyed object and the pickup roller can be larger than the friction force between the conveyed object that is taken out second or later and the pickup roller, probability of double feeding of the first conveyed object can be lowered. Further, because the first conveyance speed is lower than the second conveyance speed, accuracy of the type detection process can be enhanced.

Whether a conveyed object is in the overlay state is input to the conveyance state judging portion 71 from the overlay detecting portion 65, and a type of a recording medium associated with a subject tray is input to the conveyance state judging portion 71 from the type storing portion 67. The conveyance state judging portion 71 judges a conveyance state based on whether a conveyed object is in the overlay state with reference to a type of a recording medium associated with a subject tray. A conveyance state represents either a normal state or an abnormal state. Specifically, in the case where a type of a recording medium associated with a subject tray is a paper, and a conveyed object is not in the overlay state, the conveyance state judging portion 71 judges that the conveyance state is normal. In the case where a type of a recording medium associated with a subject tray is a paper, and a conveyed object is in the overlay state, the conveyance state judging portion 71 judges that the conveyance state is abnormal. Further, in the case where a type associated with a subject tray is an overlay paper, when a conveyed object is in the overlay state, the conveyance state judging portion 71 judges that the conveyance state is normal. In regard to a conveyed object a recording medium type of which is an overlay paper, a value between an attenuation rate of an ultrasonic wave in regard to one overlay paper and an attenuation rate of an ultrasonic wave in regard to two overlay papers overlaid on each other can be defined as a threshold value for an overlay paper. In this case, the threshold value for an overlay paper is obtained by an experiment or simulation. In the case where an attenuation rate of an ultrasonic wave acquired by the sensor controlling portion 61 is equal to or larger than the threshold value for an overlay paper, the conveyance state judging portion 71 judges that the conveyance state is normal. In the case where an attenuation state of an ultrasonic wave acquired by the sensor controlling portion 61 is smaller than the threshold value for an overlay paper, the conveyance state judging portion 71 judges that the conveyance state is abnormal.

In the case where the conveyance state judging portion 71 judges that the conveyance state is abnormal, the stop controlling portion 73 stops conveyance of a conveyed object by the paper feed unit 150. Thus, because formation of an image on a double fed conveyed object can be prevented, an occurrence of an error such as paper jam caused by a conveyed object being stuck, etc. can be prevented, and the image forming unit 140 can be prevented from being damaged and malfunctioning. Further, overloading of the image forming unit 140 due to formation of an image with a conveyed object being stuck can be prevented, and the image forming unit 140 can be prevented from malfunctioning due to overloading.

In the case where conveyance of a conveyed object is stopped by the stop controlling portion 73, the notifying portion 75 notifies the user. For example, an error message is displayed in the display unit 161. Further, in the case where a job executed by the job executing portion 51 is a print job received from an external computer, a message is transmitted to a PC that has transmitted the print job. Thus, because a user who has provided an instruction for executing a job can be notified of interruption of a job, the user can work on removing a conveyed object from the conveyance path, etc. and can resolve the interruption of the job early.

Figure 6:
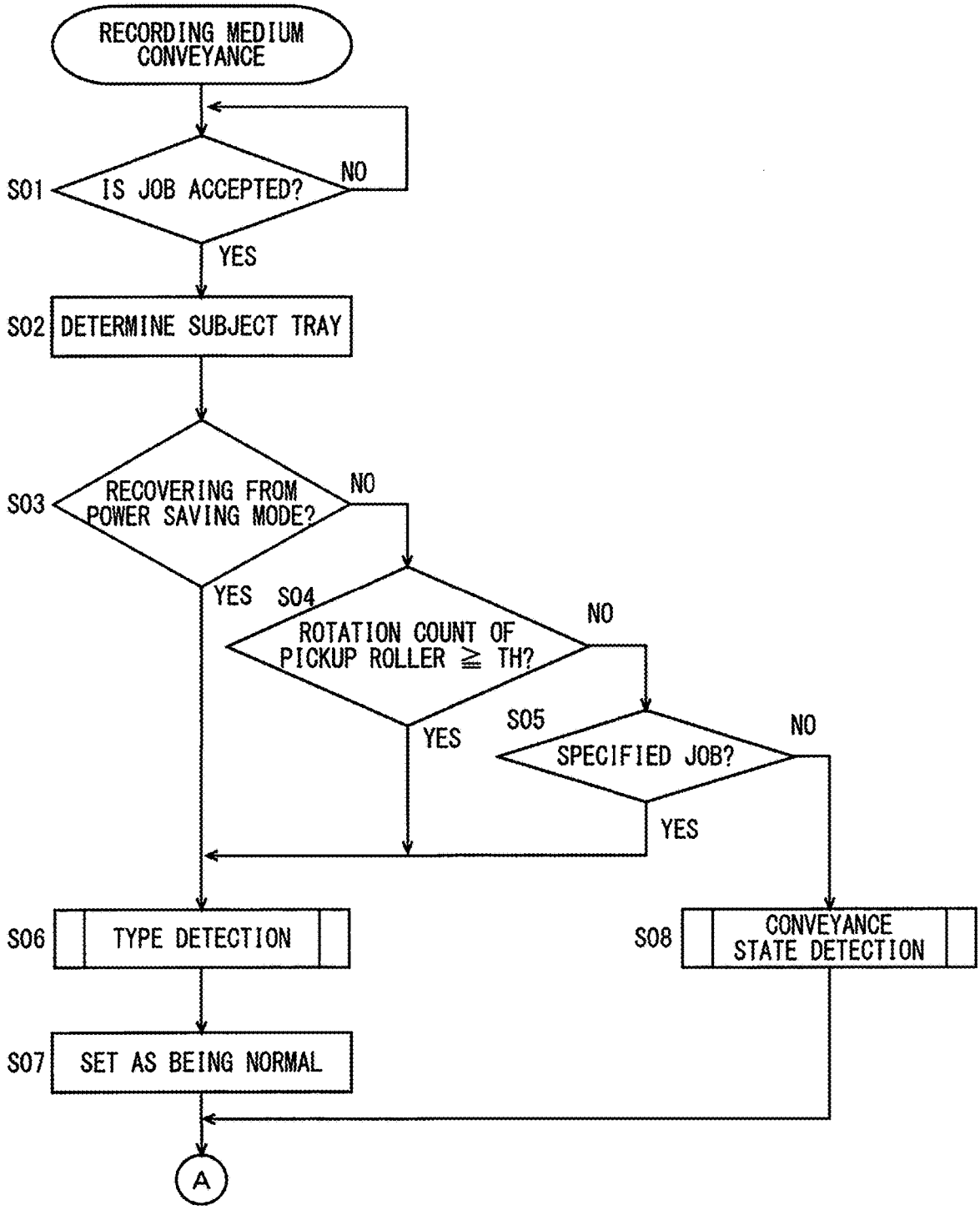
FIG. 6 is a first flowchart showing one example of a flow of a recording medium conveyance process.
Figure 7:
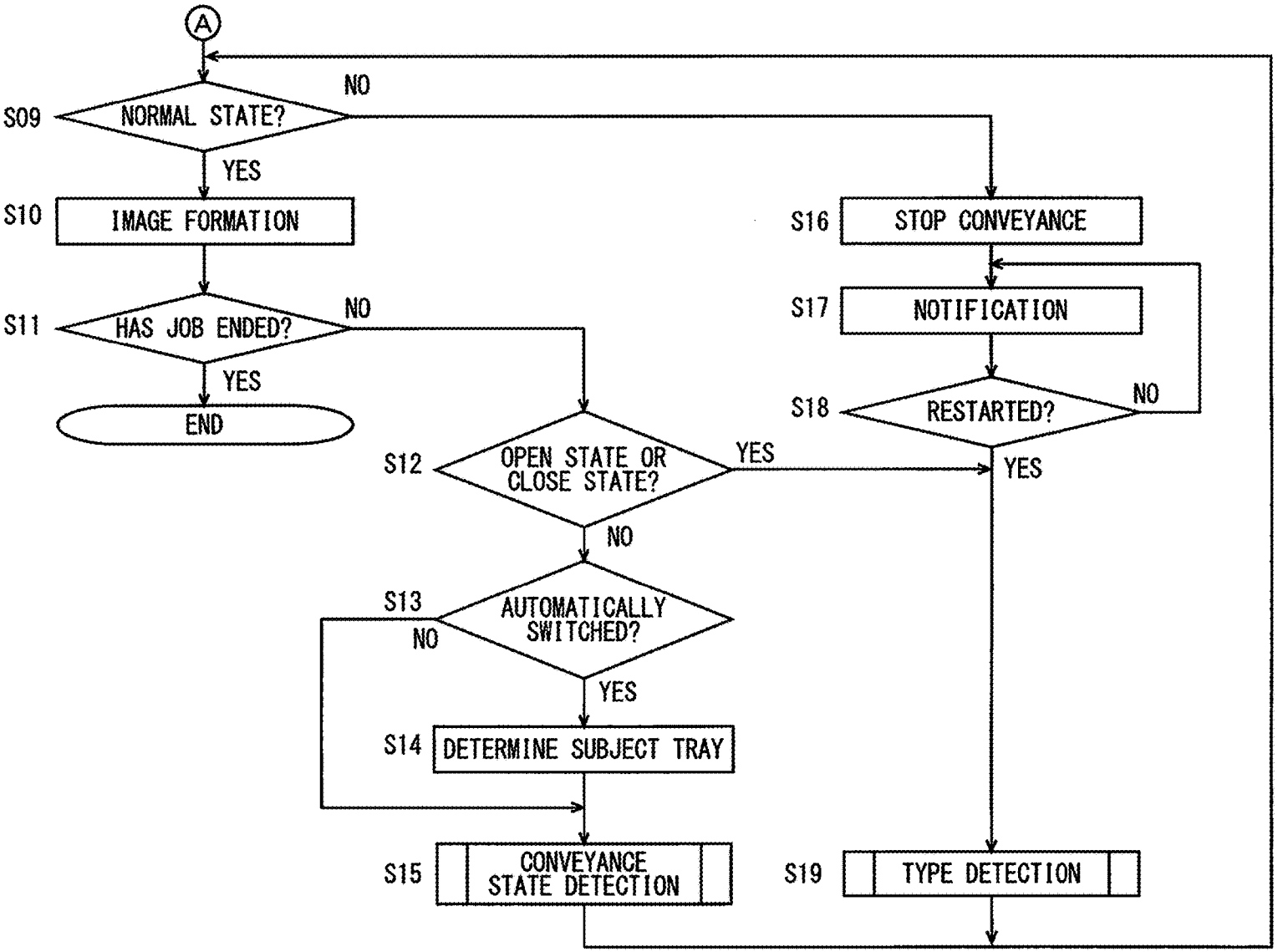
FIG. 7 is a second flowchart showing the one example of the flow of the recording medium conveyance process.

FIGS. 6 and 7 are flowcharts showing one example of a flow of a recording medium conveyance process. The recording medium conveyance process is a process executed by the CPU 111 in the case where the CPU 111 included in the MFP 100 executes the recording medium conveyance program. With reference to FIGS. 6 and 7, the CPU 111 included in the MFP 100 judges whether a job has been accepted (step S01). The CPU 111 waits until a job is accepted (NO in the step S01). If a job is accepted (YES in the step S01), the process proceeds to the step S02.

In the step S02, a subject tray is determined, and the process proceeds to the step S03. A tray designated by the user or a tray defined by default from among the paper feed trays 151, 152, 153 and the manual paper feed tray 154 is determined as a subject tray. In the step S03, whether the MFP 100 is recovering from a power saving mode is judged. If a behavior mode is recovered from the power saving mode, the process proceeds to the step S06. If not, the process proceeds to the step S04.

In the step S04, whether the cumulative rotation count of a pickup roller corresponding to the subject tray is equal to or larger than a threshold value Th is judged. If the cumulative rotation count of the pickup roller corresponding to the subject tray is equal to or larger than the threshold value Th, the process proceeds to the step S06. If not, the process proceeds to the step S05. In the step S05, whether the job accepted in the step S01 is a specified job is judged. If the job is a specified job, the process proceeds to the step S06. If not, the process proceeds to the step S08. In the case where the process proceeds to the step S06, execution of the overlay detection process is prevented. The type detection process is executed in the step S06, and the process proceeds to the step S07. While details will be described below, the type detection process is a process of detecting a type of a conveyed object. A conveyance state is set as being normal in the step S07, and the process proceeds to the step S09.

In the case where the process proceeds to the step S08, execution of the overlay detection process is not prevented. A conveyance state detection process is executed in the step S08, and the process proceeds to the step S09. While details will be described below, the conveyance state detection process is a process of detecting a conveyance state of a conveyed object. The conveyance state includes a normal state and an abnormal state.

In the step S09, the process branches in accordance with a conveyance state. If the conveyance state of a conveyed object is normal, the process proceeds to the step S10. If not, the process proceeds to the step S16. An image is formed on the conveyed object in the step S10, and the process proceeds to the step S11. Specifically, image formation is started by the image forming unit 140. The timing roller 45 starts rotating, and the conveyed object is conveyed. In the step S11, whether a job has ended is judged. If the job has ended, the process ends. If not, the process proceeds to the step S12.

In the step S12, whether the subject tray has changed from the open state to the close state is judged. If the subject tray has changed from the open state to the close state, the process proceeds to the step S13. If not, the process proceeds to the step S19. In the case where the process proceeds to the step S19, execution of the overlay detection process is prevented. The type detection process is executed in the step S19, and the process returns to the step S09.

In the step S13, whether the subject tray has been switched automatically is judged. For example, in the case where a job provides an instruction for switching a tray, the subject tray is automatically switched. If the subject tray has been automatically switched, the process proceeds to the step S14. If not, the step S14 is skipped, and the process proceeds to the step S15. A tray to which the tray after the switch is determined as a subject tray in the step S14, and the process proceeds to the step S15. In the case where the tray after the switch is not associated with a type of a recording medium, a type of a recording medium associated with the subject tray before the switch is associated with the tray after the switch and stored in the RAM 114. The conveyance state detection process is executed in the step S15, and the process returns to the step S09.

The process proceeds to the step S16 in the case where it is judged that the conveyance state of a conveyed object is abnormal. Conveyance of the conveyed object is stopped in the step S16, and the process proceeds to the step S17. The timing roller 45 stops rotating. Thus, conveyance of the conveyed object is stopped before an image is formed on the conveyed object. The user is notified of stop of conveyance of the conveyed object in the step S17, and the process proceeds to the step S18. In the step S18, the user resolves abnormality by removing the conveyed object from a conveyance path, etc. and whether conveyance has restarted is judged. If conveyance has restarted, the process proceeds to the step S19. If not, the process returns to the step S17. In the case where the process proceeds to the step S19, execution of the overlay detection process is prevented. The type detection process is executed in the step S19, and the process returns to the step S09.

Figure 8:
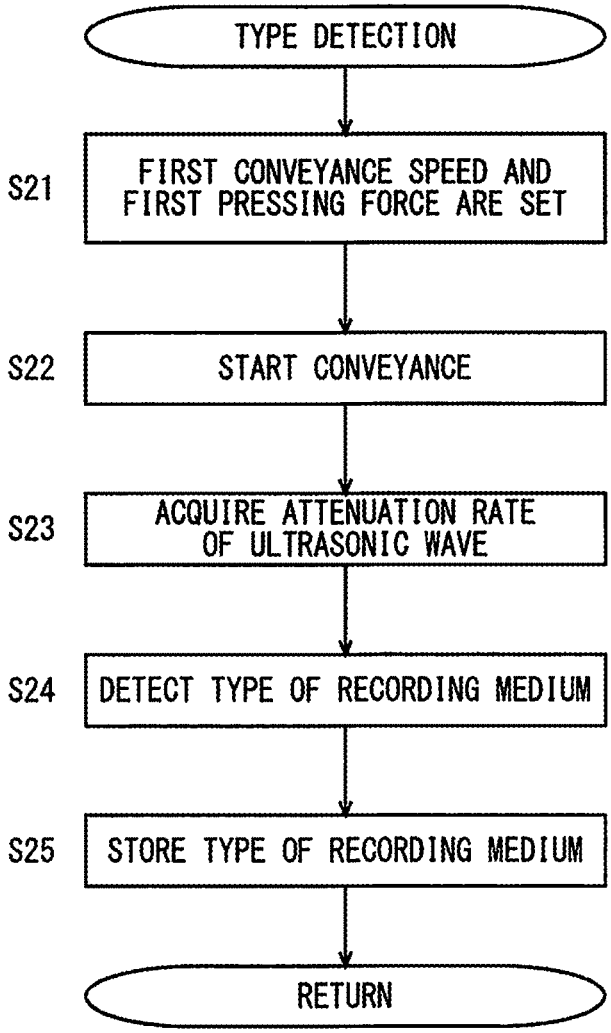
FIG. 8 is a flowchart showing one example of a flow of a type detection process.

FIG. 8 is a flowchart showing one example of a flow of the type detection process. The type detection process is a process executed in the steps S06 and S19 in the recording medium conveyance process. A subject tray is determined before the type detection process is executed. With reference to FIG. 8, a first conveyance speed and a first pressing force are set in the step S21, and the process proceeds to the step S22. Conveyance of a recording medium is started from the subject tray in the step S22, and the process proceeds to the step S23.

An attenuation rate of an ultrasonic wave is acquired in the step S23, and the process proceeds to the step S24. A type of a recording medium is detected based on the attenuation rate of the ultrasonic wave in the step S24, and the process proceeds to the step S25. If the attenuation rate of the recording medium is equal to or smaller than a threshold value, an overlay paper is detected. If the attenuation rate is larger than the threshold value, a paper is detected as a type of the recording medium. In the step S25, the type of the recording medium is stored in association with the subject tray, and the process returns to the recording medium conveyance process.

Figure 9:
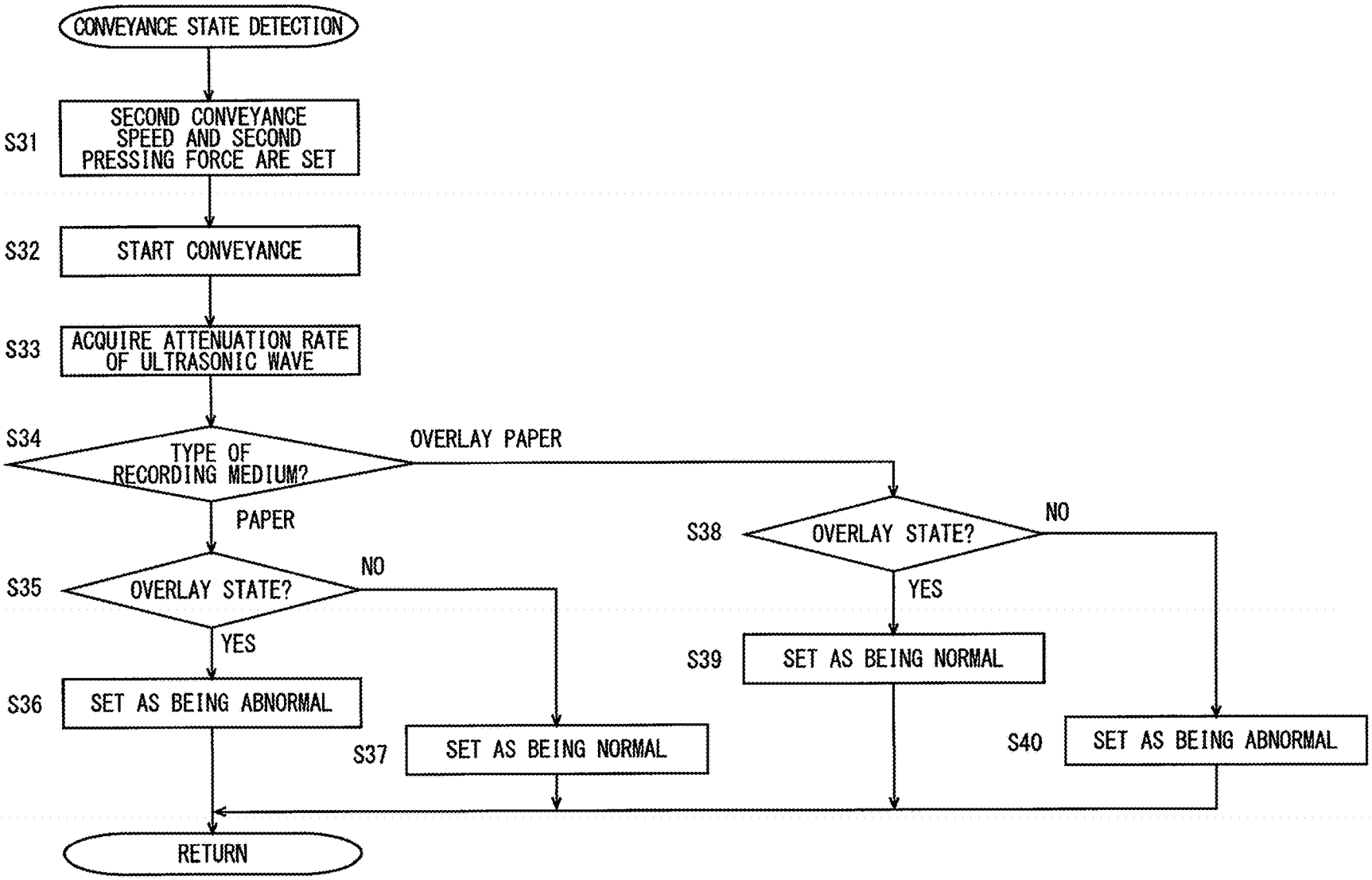
FIG. 9 is a flowchart showing one example of a flow of a conveyance state detection process.

FIG. 9 is a flowchart showing one example of a flow of a conveyance state detection process. The conveyance state detection process is a process executed in the steps S08 and S15 in the recording medium conveyance process. A subject tray is determined before the conveyance state detection process is executed. With reference to FIG. 8, a second conveyance speed and a second pressing force are set in the step S31, and the process proceeds to the step S32. Conveyance of a conveyed object is started from the subject tray in the step S32, and the process proceeds to the step S33.

An attenuation rate of an ultrasonic wave is acquired in the step S33, and the process proceeds to the step S34. In the step S34, the process branches in accordance with a type of a recording medium associated with the subject tray. If the type of the recording medium is a paper, the process proceeds to the step S35. If the type of the recording medium is an overlay paper, the process proceeds to the step S38. In the step S35, whether the conveyed object is the overlay state is judged based on the attenuation rate of the ultrasonic wave acquired in the step S33. If the conveyed object is in the overlay state, the process proceeds to the step S36. If not, the process proceeds to the step S37. In the step S36, the conveyance state is set as being abnormal, and the process returns to the recording medium conveyance process. In the step S37, the conveyance state is set as being normal, and the process returns to the recording medium conveyance process.

In the step S38, whether the conveyed object is in the overlay state is judged based on the attenuation rate of the ultrasonic wave acquired in the step S33. If the conveyed object is in the overlay state, the process proceeds to the step S39. If not, the process proceeds to the step S40. In the step S39, the conveyance state is set as being normal, and the process returns to the recording medium conveyance state. In the step S40, the conveyance state is set as being abnormal, and the process returns to the recording medium conveyance process.

As described above, the MFP 100 in the present embodiment functions as a recording medium conveyance device, includes the paper feed trays 151, 152, 153 and the manual paper feed tray 154 that store recording media, takes out a recording medium stored in a storage and conveys the recording medium as a conveyed object. Further, the MFP 100 includes the ultrasonic sensor 59 that outputs a value indicating an attenuation amount of an ultrasonic wave caused by a conveyed object and detects whether the conveyed object is an overlay state in which a gap is present in the conveyed object based on a result of output by the ultrasonic sensor 59. In the case where the paper feed unit 150 sequentially conveys a plurality of conveyed objects multiple times, the MFP 100 prevents execution of the overlay detection process with respect to a first conveyed object that is to be conveyed first among the plurality of conveyed objects. Therefore, the first conveyed object can be prevented from erroneously judged to be in the overlay state. Specifically, an overlay paper such as an envelope can be prevented from being judged as being double fed.

Further, the MFP 100 detects a type of a recording medium of the first conveyed object based on a result of output by the ultrasonic sensor 59 in regard to the first conveyed object that is to be conveyed first. Therefore, the user is not required to set the type of a recording medium stored in the storage. Therefore, a user operation can be simplified.

Further, in the case where the MFP 100 sequentially conveys a plurality of conveyed objects multiple times, the MFP 100 judges a conveyance state of a second conveyed object that is to be conveyed second or later by a conveyance means among the plurality of conveyed objects based on a result of execution of the overlay detection process executed after execution of the type detection process. Therefore, because the conveyance state of the second conveyed object is judged based on the type of a recording medium of the first conveyed object and whether the second conveyed object is in the overlay state, whether the second conveyed object is being conveyed normally can be judged.

Further, in the case where sequentially conveying a plurality of conveyed objects multiple times, the MFP 100 judges the conveyance state of the second conveyed object based on results of output by the ultrasonic sensor 59 in regard to the first conveyed object that is to be conveyed first and the second conveyed object that is to be conveyed second or later among the plurality of conveyed objects. Therefore, the second conveyed object can be prevented from being misjudged as being double fed. Specifically, an overlay paper such as an envelope can be prevented from being misjudged as being double fed.

Further, the conveyance speed at which the MFP 100 conveys the first conveyed object that is to be conveyed first is lower than the conveyance speed at which the MFP 100 conveys the second conveyed object. Therefore, because the attenuation amount of the ultrasonic wave caused by the first conveyed object is accurately measured, accuracy can be enhanced.

Further, because the MFP 100 stops conveyance of a conveyed object in the case where judging that the conveyance state is abnormal, the conveyed object can be prevented from being conveyed in an abnormal state, and malfunction of the device can be prevented in advance.

Further, in the case where conveyance of a conveyed object is to be stopped, the MFP 100 notifies the user. Therefore, because being notified of stop of conveyance, the user can work on resolving abnormality early.

Further, the first conveyed object is one or more recording media that are to be taken out first from the storage after a subject tray among the paper feed trays 151, 152, 153 and the manual paper feed tray 154 changes from the open state to the close state. Therefore, detection of the overlay state of the first conveyed object is prevented. Thus, even in the case where a stored recording medium is different before and after the opening and closing of the subject tray, the user is not required to set information relating to the recording medium stored in the subject tray, for example, the type of the recording medium.

Further, the first conveyed object is one or more recording media that are to be conveyed first since execution of a job from a subject tray among the paper feed trays 151, 152, 153 and the manual paper feed tray 154. Therefore, execution of the overlay detection process with respect to the first conveyed object is prevented. Thus, even in the case where a recording medium stored in the subject tray is changed before execution of a job, the user is not required to set information relating to the recording medium stored in the subject tray, for example, the type of the recording medium.

Further, in the MFP 100, the pressure of a pickup roller that presses a recording medium in order to convey a conveyed object that is to be conveyed first from a subject tray among the paper feed trays 151, 152, 153 and the manual paper feed tray 154 is larger than the pressure of the pickup roller that presses a recording medium in order to convey a conveyed object that is to be conveyed second or later. Therefore, probability of a conveyed object being in the overlay state in which a plurality of recording media are overlaid on one another can be lowered.

Although embodiments of the present invention have been described and illustrated in detail, the disclosed embodiments are made for purpose of illustration and example only and not limitation. The scope of the present invention should be interpreted by terms of the appended claims

What is claimed is:

1. A recording medium conveyance device comprising:

a storage that stores a recording medium;

a conveyer that takes out the recording medium stored in the storage and conveys the recording medium as a conveyed object;

an ultrasonic sensor that outputs a value indicating an attenuation amount of an ultrasonic wave caused by the conveyed object; and a hardware processor, wherein the hardware processor executes an overlay detection process of detecting whether the conveyed object is in an overlay state in which a gap is present based on a result of output by the ultrasonic sensor, determines whether the conveyed object is a first conveyed object that is to be conveyed first by the conveyer; and prevents execution of the overlay detection process with respect to a first conveyed object that is to be conveyed first by the conveyer.

2. The recording medium conveyance device according to claim 1, wherein the hardware processor, in the case where the conveyer sequentially conveys a plurality of the conveyed objects, prevents execution of the overlay detection process with respect to the first conveyed object among the plurality of the conveyed objects.

3. The recording medium conveyance device according to claim 1, wherein the hardware processor further executes a type detection process of detecting a type of the first conveyed object based on a result of output by the ultrasonic sensor in regard to the first conveyed object.

4. The recording medium conveyance device according to claim 3, wherein the hardware processor, in the case where the conveyer sequentially conveys the plurality of the conveyed objects multiple times, further judges a conveyance state of a second conveyed object that is to be conveyed second or later among the plurality of the conveyed objects by the conveyer based on a result of the overlay detection process that is executed after execution of the type detection process.

5. The recording medium conveyance device according to claim 4, wherein a conveyance speed of the first conveyed object is lower than a conveyance speed of the second conveyed object.

6. The recording medium conveyance device according to claim 4, wherein the hardware processor further stops conveyance by the conveyer in the case where judging that the conveyance state is abnormal.

7. The recording medium conveyance device according to claim 6, wherein the hardware processor further notifies a user in the case where conveyance by the conveyer is stopped.

8. The recording medium conveyance device according to claim 1, wherein the storage can change between an open state in which the storage is opened in order to store the recording medium and a close state in which the recording medium is takable, and the first conveyed object is the one or more recording media that are to be taken out first from the storage after the storage changes from the open state to the close state.

9. The recording medium conveyance device according to claim 1, wherein the hardware processor further executes a job to form an image on the conveyed object that is conveyed by the conveyer, and the first conveyed object is the one or more recording media that are to be taken out first from the storage since the job is executed by the hardware processor.

10. The recording medium conveyance device according to claim 1, wherein the conveyer has a pickup roller that abuts against the recording medium at a top among The plurality of the recording media stored in the storage, and a pressure applied to the recording medium by the pickup roller that presses the recording medium in order for the conveyer to convey the conveyed object that is to be conveyed first is larger than a pressure applied to the recording medium by the pickup roller that presses the recording medium in order for the conveyer to convey the conveyed object that is to be conveyed second or later.

11. A recording medium conveyance device comprising:

a storage that stores a recording medium;

a conveyer that takes out the recording medium stored in the storage and conveys the recording medium as a conveyed object;

an ultrasonic sensor that outputs a value indicating an attenuation amount of an ultrasonic wave caused by the conveyed object; and a hardware processor that, in the case where the conveyer sequentially conveys a plurality of the conveyed objects, judges a conveyance state of a second conveyed object that is to be conveyed second or later based on a result of output by the ultrasonic sensor in regard to each of a first conveyed object that is to be conveyed first by the conveyer and the second conveyed object.

12. The recording medium conveyance device according to claim 11, wherein a conveyance speed of the first conveyed object is lower than a conveyance speed of the second conveyed object.

13. The recording medium conveyance device according to claim 11, wherein the hardware processor further stops conveyance by the conveyer in the case where judging that the conveyance state is abnormal.

14. The recording medium conveyance device according to claim 13, wherein the hardware processor further notifies a user in the case where conveyance by the conveyer is stopped.

15. The recording medium conveyance device according to claim 11, wherein the storage can change between an open state in which the storage is opened in order to store the recording medium and a close state in which the recording medium is takable, and the first conveyed object is the one or more recording media that are to be taken out first from the storage after the storage changes from the open state to the close state.

16. The recording medium conveyance device according to claim 11, wherein the hardware processor further executes a job to form an image on the conveyed object that is conveyed by the conveyer, and the first conveyed object is the one or more recording media that are to be taken out first from the storage since the job is executed by the hardware processor.

17. The recording medium conveyance device according to claim 11, wherein the conveyer has a pickup roller that abuts against the recording medium at a top among the plurality of the recording media stored in the storage, and a pressure applied to the recording medium by the pickup roller that presses the recording medium in order for the conveyer to convey the conveyed object that is to be conveyed first is larger than a pressure applied to the recording medium by the pickup roller that presses the recording medium in order for the conveyer to convey the conveyed object that is to be conveyed second or later.

18. A recording medium conveyance method that is executed in an image forming apparatus, the image forming apparatus comprising:

a storage that stores a recording medium;

a conveyer that takes out the recording medium stored in the storage and conveys the recording medium as a conveyed object; and an ultrasonic sensor that outputs a value indicating an attenuation amount of an ultrasonic wave caused by the conveyed object, and the recording medium conveyance method causing the image forming apparatus to execute:

an overlay detection step of executing an overlay detection process of detecting whether the conveyed object is in an overlay state in which a gap is present based on a result of output by the ultrasonic sensor;

a determination step of determining whether the conveyed object is a first conveyed object that is to be conveyed first by the conveyer; and a prevention step of preventing execution of the overlay detection process with respect to a first conveyed object that is to be conveyed first by the conveyer.

19. A recording medium conveyance method that is executed in an image forming apparatus, the image forming apparatus comprising:

a storage that stores a recording medium;

a conveyer that takes out the recording medium stored in the storage and conveys the recording medium as a conveyed object; and an ultrasonic sensor that outputs a value indicating an attenuation amount of an ultrasonic wave caused by the conveyed object, and the recording medium conveyance method including a conveyance state step of, in the case where the conveyer sequentially conveys a plurality of the conveyed objects, judging a conveyance state of a second conveyed object that is to be conveyed second or later among the plurality of the conveyed objects by the conveyer based on a result of output by the ultrasonic sensor in regard to a first conveyed object that is to be conveyed first by the conveyer among the plurality of the conveyed objects.

20. A non-transitory computer-readable recording medium encoded with a recording medium conveyance program that is executed in a computer that controls an image forming apparatus, the image forming apparatus comprising:

a storage that stores a recording medium;

a conveyer that takes out the recording medium stored in the storage and conveys the recording medium as a conveyed object;

an ultrasonic sensor that outputs a value indicating an attenuation amount of an ultrasonic wave caused by the conveyed object, and the recording medium conveyance program causing the computer to execute:

an overlay detection step of executing an overlay detection process of detecting whether the conveyed object is in an overlay state in which a gap is present based on a result of output by the ultrasonic sensor;

a determination step of determining whether the conveyed object is a first conveyed object that is to be conveyed first by the conveyer; and a prevention step of preventing execution of the overlay detection process with respect to a first conveyed object that is to be conveyed first by the conveyer.

21. A non-transitory computer-readable recording medium encoded with a recording medium conveyance program that is executed in a computer that controls an image forming apparatus, the image forming apparatus comprising:

a storage that stores a recording medium;

a conveyer that takes out the recording medium stored in the storage and conveys the recording medium as a conveyed object;

an ultrasonic sensor that outputs a value indicating an attenuation amount of an ultrasonic wave caused by the conveyed object, and the recording medium conveyance program causing the computer to execute a conveyance state step of, in the case where the conveyer sequentially conveys a plurality of the conveyed objects, judging a conveyance state of a second conveyed object that is to be conveyed second or later by the conveyer among the plurality of the conveyed objects based on a result of output by the ultrasonic sensor in regard to a first conveyed object that is to be conveyed first by the conveyer.

* * * * *